US011502441B1

(12) United States Patent
Tang

(10) Patent No.: US 11,502,441 B1
(45) Date of Patent: Nov. 15, 2022

(54) ELECTRICAL CONNECTOR ASSEMBLY

(71) Applicant: Bellwether Electronic (Kunshan) Co., Ltd, Kunshan (CN)

(72) Inventor: Xiang-Biao Tang, Kunshan (CN)

(73) Assignee: Bellwether Electronic (Kunshan) Co., Ltd, Kunshan (CN)

( * ) Notice: Subject to any disclaimer, the term of this patent is extended or adjusted under 35 U.S.C. 154(b) by 0 days.

(21) Appl. No.: 17/472,698

(22) Filed: Sep. 13, 2021

(30) Foreign Application Priority Data

Jun. 8, 2021 (CN) ..... 202121277202.2

(51) Int. Cl.
*H01R 13/424* (2006.01)
*H01R 4/18* (2006.01)

(52) U.S. Cl.
CPC ..... *H01R 13/424* (2013.01); *H01R 4/184* (2013.01)

(58) Field of Classification Search
CPC .. H01R 13/424; H01R 13/426; H01R 13/428; H01R 13/432; H01R 13/434; H01R 13/436; H01R 13/02; H01R 13/025; H01R 4/184
USPC ..... 439/752.5
See application file for complete search history.

(56) References Cited

U.S. PATENT DOCUMENTS

| | | | | |
|---|---|---|---|---|
| 9,090,804 | B2 * | 7/2015 | Tegen | C08G 18/771 |
| 9,680,236 | B2 * | 6/2017 | Ngo | H01R 4/48 |
| 10,050,395 | B2 * | 8/2018 | Ngo | H01R 4/023 |
| 11,031,742 | B2 * | 6/2021 | Schmitz | H01R 13/113 |
| 2013/0012072 | A1 * | 1/2013 | Costello | H01R 13/18 439/786 |
| 2014/0158395 | A1 * | 6/2014 | Billman | H01R 31/085 174/68.2 |
| 2019/0089093 | A1 * | 3/2019 | Liu | H01R 4/46 |
| 2020/0161783 | A1 * | 5/2020 | He | H01R 12/7076 |

* cited by examiner

*Primary Examiner* — Harshad C Patel
(74) *Attorney, Agent, or Firm* — Li & Cai Intellectual Property Office

(57) ABSTRACT

An electrical connector assembly is provided. The electrical connector assembly includes a housing and two electrically conductive connection members. Each of the two electrically conductive connection members is arranged in the housing and is connected to at least one electrically conductive cable. The electrically conductive connection member has an electrically conductive terminal, a cable connection member, and a terminal holding member. The electrically conductive terminal has two leaf springs that are opposite to each other and a U-shaped connection part connected between the two leaf springs. The cable connection member is bent and has a first connection part and a second connection part. The terminal holding member has two sheet bodies that are arranged opposite to each other and a plate-shaped connection part connected between same sides of the two sheet bodies, so that the terminal holding member is in a shape of an inverted U.

12 Claims, 10 Drawing Sheets

ELECTRICAL CONNECTOR ASSEMBLY

CROSS-REFERENCE TO RELATED PATENT APPLICATION

This application claims the benefit of priority to China Patent Application No. 202121277202.2, filed on Jun. 8, 2021 in People's Republic of China. The entire content of the above identified application is incorporated herein by reference.

Some references, which may include patents, patent applications and various publications, may be cited and discussed in the description of this disclosure. The citation and/or discussion of such references is provided merely to clarify the description of the present disclosure and is not an admission that any such reference is "prior art" to the disclosure described herein. All references cited and discussed in this specification are incorporated herein by reference in their entireties and to the same extent as if each reference was individually incorporated by reference.

FIELD OF THE DISCLOSURE

The present disclosure relates to an electrical connector assembly, and more particularly to an electrical connector assembly having an enhanced structural strength.

BACKGROUND OF THE DISCLOSURE

Electrical connector assemblies have a complex internal structure design and a large number of components, such that disassembly and assembly of the electrical connector assemblies are not easily performed. In addition, repeated plugging and unplugging of the electrical connector assemblies easily causes internal components to loosen or shift, which results in poor contact.

Therefore, how to improve a structural design to overcome the above issues has become one of the important issues to be solved in the related field.

SUMMARY OF THE DISCLOSURE

In response to the above-referenced technical inadequacies, the present disclosure provides an electrical connector assembly.

In one aspect, the present disclosure provides an electrical connector assembly including a housing and two electrically conductive connection members. One of two sides of the housing that are opposite to each other has two first sockets, and another one of the two sides of the housing that are opposite to each other has an opening. Each of the two electrically conductive connection members is arranged in the housing and connected to at least one electrically conductive cable. Each of the two electrically conductive connection members includes an electrically conductive terminal, a cable connection member, and a terminal holding member. The electrically conductive terminal is arranged in the housing. The electrically conductive terminal is integrally formed. The electrically conductive terminal has two leaf springs that are opposite to each other and a U-shaped connection part connected between the two leaf springs. Each of the two leaf springs has a base and a plurality of elastic contact arms, the plurality of elastic contact arms are connected to a side of the base, and a second socket is formed between the two leaf springs. The cable connection member is connected to the electrically conductive terminal and the corresponding electrically conductive cable. The cable connection member is bent and has a first connection part and a second connection part. The first connection part is connected to a terminal of the electrically conductive cable by crimping, and the second connection part is coupled to the U-shaped connection part. The terminal holding member is arranged in the housing and at a periphery of the electrically conductive terminal. The terminal holding member has two sheet bodies that are arranged opposite to each other and a plate-shaped connection part connected between same sides of the two sheet bodies, such that a guide opening that is opposite to the plate-shaped connection part is formed on a side of the terminal holding member. The two sheet bodies are bent in a direction towards each other such that a third socket is formed therebetween. When the electrically conductive terminal is assembled in the terminal holding member, the electrically conductive terminal is inserted into the terminal holding member through the guide opening. When the two electrically conductive connection members are assembled in the housing through the opening, the second sockets of the two electrically conductive terminals correspond to the two first sockets, and the second socket of each of the two electrically conductive terminals is communicated with the corresponding first socket.

In certain embodiments, when the electrically conductive terminal is not assembled in the terminal holding member, a width of the second socket is less than a width of the third socket.

In certain embodiments, the housing further has a first side wall and a second side wall that are opposite to each other, and the housing has a third side wall and a fourth side wall that are arranged between the first side wall and the second side wall and are opposite to each other. Two guide members are arranged on an inner side of the first side wall, and each of the two guide members has a sliding groove and a bump arranged at one terminal of the sliding groove. Two cantilever members are arranged on the second side wall, and each of the two cantilever members has a first terminal and a second terminal that are opposite to each other. The first terminal is connected to the second side wall and the second terminal is overhung, and a thickness of the second terminal is greater than a thickness of the first terminal.

In certain embodiments, the plate-shaped connection part correspondingly abuts the two second terminals of the two cantilever members.

In certain embodiments, the U-shaped connection part is arranged in a corresponding one of the two sliding grooves and abuts a corresponding one of the bumps.

In certain embodiments, the housing further has a partition. The partition is arranged in the housing and connected between the first side wall and the second side wall so as to divide an inside of the housing into a first accommodating space and a second accommodating space. The two electrically conductive connection members are respectively arranged in the first accommodating space and the second accommodating space. A first stop block and a second stop block are respectively arranged on two sides of the partition, a third stop block is arranged on an inner side of the third side wall, and a fourth stop block is arranged on an inner side of the fourth side wall. The first stop block and the third stop block are arranged in the first accommodating space, and the second stop block and the fourth stop block are arranged in the second accommodating space.

In certain embodiments, the terminal holding member further has two bent segments. Each of the two bent segments is adjacent to the guide opening and is correspondingly connected to one of the two sheet bodies. When one of the two electrically conductive connection members is assembled in the first accommodating space, the two bent segments of the terminal holding member of the one of the two electrically conductive connection members respectively abut the first stop block and the third stop block. When another one of the two electrically conductive connection members is assembled in the second accommodating space, the two bent segments of the terminal holding member of the another one of the two electrically conductive connection members respectively abut the second stop block and the fourth stop block.

In certain embodiments, the electrical connector assembly further includes a cover detachably disposed on the side of the housing that has the opening. When the cover is disposed on the housing, an inner side of the cover is next to the partition.

In certain embodiments, the terminal holding member further has two through holes, the electrically conductive terminal further has two cantilever hooks corresponding to the two through holes, and each of the two cantilever hooks is arranged between the base and the plurality of elastic contact arms. When the electrically conductive terminal is inserted into the terminal holding member through the guide opening, each of the two cantilever hooks is engaged to the corresponding through hole.

In certain embodiments, a terminal of each of the two cantilever hooks has an inclined surface, and the inclined surface extends and inclines inwardly in an insertion direction along which the electrically conductive terminal is inserted into the terminal holding member.

In certain embodiments, the U-shaped connection part has two bar-shaped arms and a U-shaped arm. The two bar-shaped arms are respectively connected to the two bases of the two leaf springs, and the U-shaped arm is connected between the same sides of the two bar-shaped arms. The U-shaped arm and the plate-shaped connection part are respectively arranged on two sides of the electrically conductive connection member that are opposite to each other.

In certain embodiments, the electrically conductive connection member has at least one fastener, and each of the two bar-shaped arms has at least one first through hole that correspond to each other. The second connection part of the cable connection member is arranged between the two bar-shaped arms, and the second connection part has at least one second through hole. The at least one second through hole is arranged between two of the first through holes of the two bar-shaped arms that correspond to each other, and the at least one second through hole is correspondingly communicated with the two of the first through holes of the two bar-shaped arms that correspond to each other. The at least one fastener of the electrically conductive connection member passes through the at least one second through hole and the two of the first through holes of the two bar-shaped arms that correspond to each other, such that the second connection part is coupled to the U-shaped connection part.

Therefore, one of the beneficial effects of the present disclosure is that, by virtue of "the electrically conductive terminal having the two leaf springs that are opposite to each other and the U-shaped connection part connected between the two leaf springs", "the first connection part being connected to the one terminal of the electrically conductive cable by crimping, and the second connection part being coupled to the U-shaped connection part", and "the terminal holding member having the two sheet bodies that are arranged opposite to each other and the plate-shaped connection part connected between the same sides of the two sheet bodies, so that the terminal holding member is in the shape of the inverted U and the guide opening that is opposite to the plate-shaped connection part is formed on the side of the terminal holding member", a quantity of internal components and an assembly process can be simplified in the electrical connector assembly provided by the present disclosure, and a structural strength of the electrical connector assembly after assembly can be enhanced, such that the internal components can be prevented from loosening or shifting after repeated use.

These and other aspects of the present disclosure will become apparent from the following description of the embodiment taken in conjunction with the following drawings and their captions, although variations and modifications therein may be affected without departing from the spirit and scope of the novel concepts of the disclosure.

BRIEF DESCRIPTION OF THE DRAWINGS

The described embodiments may be better understood by reference to the following description and the accompanying drawings, in which.

DETAILED DESCRIPTION OF THE EXEMPLARY EMBODIMENTS

Figure 1:
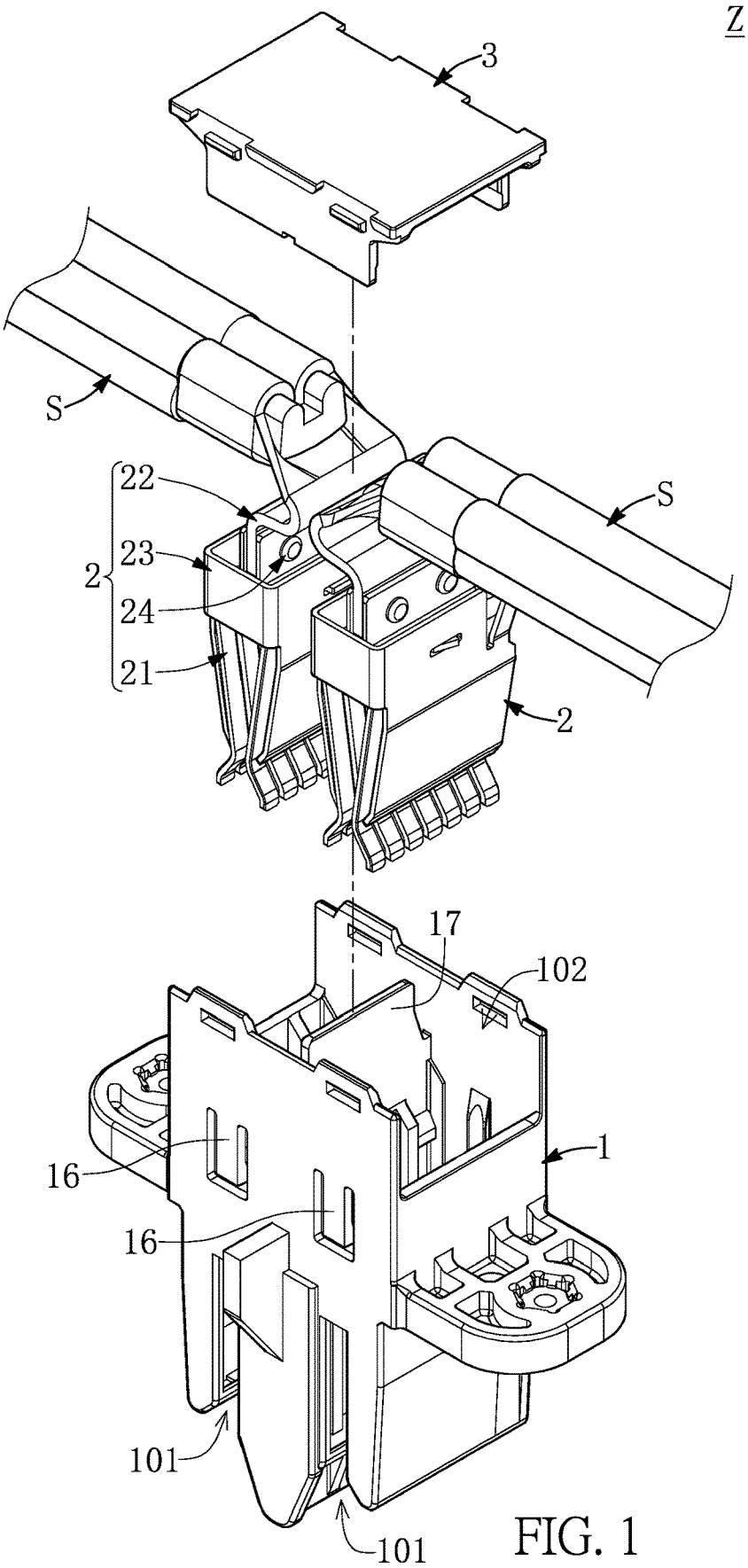
FIG. 1 is a schematic exploded view of an electrical connector assembly according to the present disclosure.

The present disclosure is more particularly described in the following examples that are intended as illustrative only since numerous modifications and variations therein will be apparent to those skilled in the art. Like numbers in the drawings indicate like components throughout the views. As used in the description herein and throughout the claims that follow, unless the context clearly dictates otherwise, the meaning of "a", "an", and "the" includes plural reference, and the meaning of "in" includes "in" and "on". Titles or subtitles can be used herein for the convenience of a reader, which shall have no influence on the scope of the present disclosure.

The terms used herein generally have their ordinary meanings in the art. In the case of conflict, the present document, including any definitions given herein, will prevail. The same thing can be expressed in more than one way.

Alternative language and synonyms can be used for any term(s) discussed herein, and no special significance is to be placed upon whether a term is elaborated or discussed herein. A recital of one or more synonyms does not exclude the use of other synonyms. The use of examples anywhere in this specification including examples of any terms is illustrative only, and in no way limits the scope and meaning of the present disclosure or of any exemplified term. Likewise, the present disclosure is not limited to various embodiments given herein. Numbering terms such as "first", "second" or "third" can be used to describe various components, signals or the like, which are for distinguishing one component/signal from another one only, and are not intended to, nor should be construed to impose any substantive limitations on the components, signals or the like.

Embodiments

Referring to FIG. 1, FIG. 1 is a schematic exploded view of an electrical connector assembly according to the present disclosure. The present disclosure provides an electrical connector assembly Z which includes a housing 1 and two electrically conductive connection members 2. The housing 1 has two sides opposite to each other, one of the two sides has two first sockets 101 and another one of the two sides has an opening 102. The two electrically conductive connection members 2 can be inserted into and arranged in the housing 1 through the opening 102, and each of the two electrically conductive connection members 2 is connected to at least one electrically conductive cable S. Each of the two electrically conductive connection members 2 has an electrically conductive terminal 21, a cable connection member 22, and a terminal holding member 23 that are arranged in the housing 1. Two terminals of the cable connection member 22 are respectively connected to the electrically conductive cable S and the electrically conductive terminal 21, and the terminal holding member 23 is engaged to the electrically conductive terminal 21.

Figure 2:
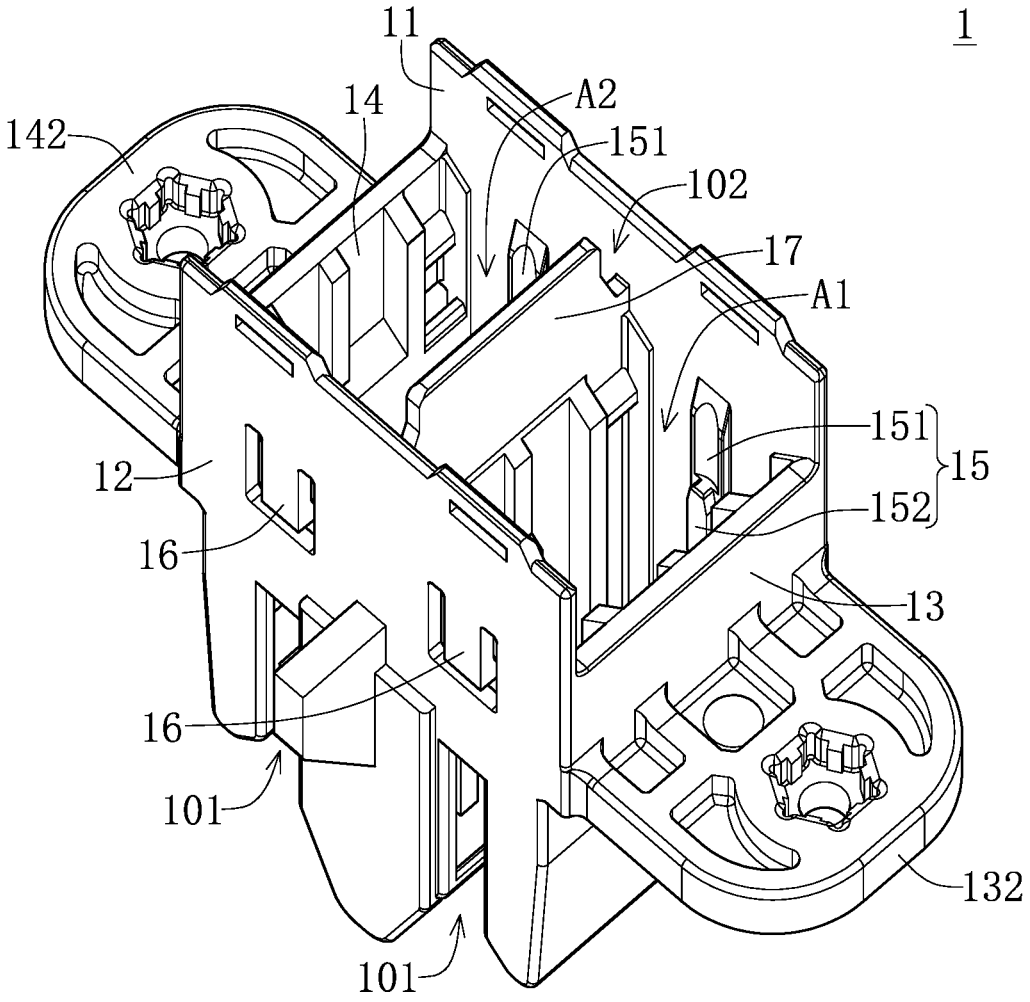
FIG. 2 is a schematic perspective view of a housing of the electrical connector assembly according to the present disclosure.

Referring to FIG. 1 and FIG. 2, FIG. 2 is a schematic perspective view of the housing of the electrical connector assembly according to the present disclosure. The housing 1 has a first side wall 11 and a second side wall 12 that are opposite to each other, and the housing 1 has a third side wall 13 and a fourth side wall 14 that are arranged between the first side wall 11 and the second side wall 12 and are opposite to each other. An inner side of the first side wall 11 has two guide members 15. Each of the two guide members 15 has a sliding groove 151 and a bump 152 arranged at one end of the sliding groove 151. The second side wall 12 has two cantilever members 16, and the two cantilever members 16 are respectively arranged opposite to the two guide members 15. Furthermore, the housing 1 is formed by having the first side wall 11, the second side wall 12, the third side wall 13, and the fourth side wall 14.

An inside of the housing 1 has a hollow cavity so as to accommodate the two electrically conductive connection members 2. Furthermore, the housing 1 has a partition 17, and the partition 17 is arranged in the housing 1 and is connected between the first side wall 11 and the second side wall 12, so as to divide the inside of the housing 1 into a first accommodating space A1 and a second accommodating space A2. The two electrically conductive connection members 2 are respectively arranged in the first accommodating space A1 and the second accommodating space A2. It should be noted that, when being viewed from the opening 102, a height of the partition 17 is higher than a height of the third side wall 13 or a height of the fourth side wall 14, and approximately equal to a height of the first side wall 11 or a height of the second side wall 12. In addition, the housing 1 has two wings 132, 142 respectively arranged on the third side wall 13 and the fourth side wall 14. Each of the two wings 132, 142, has a threaded hole, such that a screw member can be inserted into the threaded hole for fixing the electrical connector assembly Z to a proper position.

Figure 3:
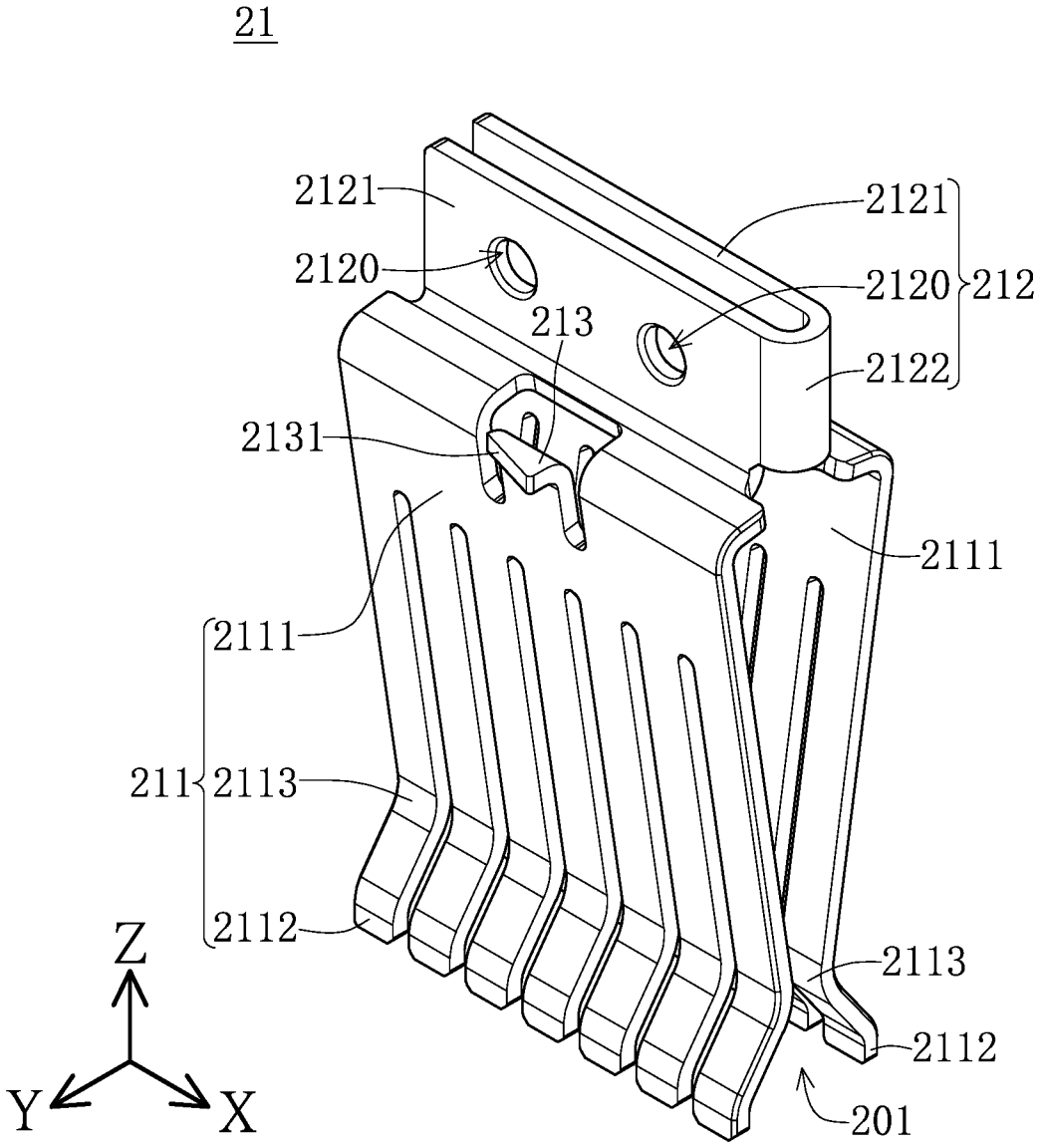
FIG. 3 is a schematic perspective view of an electrically conductive terminal of the electrical connector assembly according to the present disclosure.

Referring to FIG. 1 and FIG. 3, FIG. 3 is a schematic perspective view of the electrically conductive terminal of the electrical connector assembly according to the present disclosure. The electrically conductive terminal 21 is arranged in the housing 1, and the electrically conductive terminal 21 is integrally formed. The electrically conductive terminal 21 has two leaf springs 211 that are opposite to each other and a U-shaped connection part 212 connected between the two leaf springs 211. Each of the two leaf springs 211 has a base 2111 and a plurality of elastic contact arms 2112. The plurality of elastic contact arms 2112 is connected to one side of the base 2111. Since the two leaf springs 211 are arranged opposite to each other, the plurality of elastic contact arms 2112 of one of the two leaf springs 211 and the plurality of elastic contact arms 2112 of another one of the two leaf springs 211 are accordingly arranged opposite to each other. That is, the plurality of elastic contact arms 2112 of one of the two leaf springs 211 is arranged opposite to the plurality of elastic contact arms 2112 of the another one of the two leaf springs 2112, and a second socket 201 is formed between the two leaf springs 211.

Figure 4:
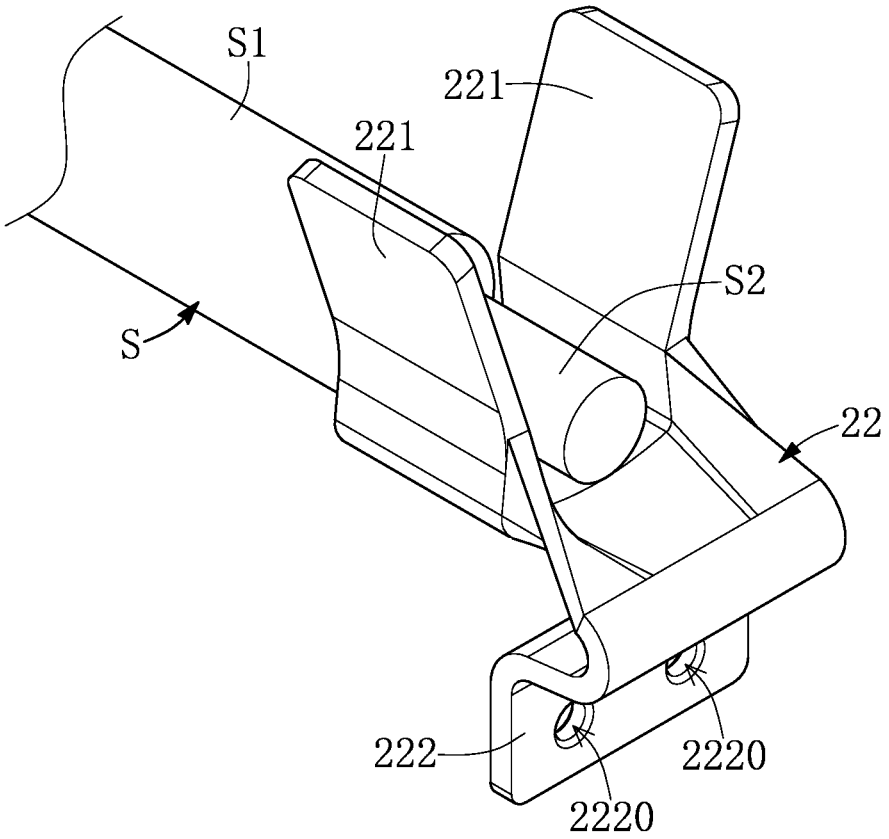
FIG. 4 is a schematic view illustrating a connection of a cable connection member to an electrically conductive cable in the electrical connector assembly according to the present disclosure.

Referring to FIG. 1 and FIG. 4, FIG. 4 is a schematic view illustrating a connection of the cable connection member to the electrically conductive cable in the electrical connector assembly according to the present disclosure. The cable connection member 22 is connected to the electrically conductive terminal 21 and the corresponding electrically conductive cable S. The cable connection member 22 is bent relative to a vertical axis and has a first connection part 221 and a second connection part 222. The first connection part 221 is connected to one terminal of the electrically conductive cable S by crimping, and the second connection part 222 is coupled to the U-shaped connection part 212. Specifically speaking, the electrically conductive cable S has a cable main body S2 and an electrically insulating material S1 that covers the cable main body S2, and the electrically insulating material S1 at the one terminal of the electrically conductive cable S where the electrically conductive cable S is connected to the first connection part 221 is removed, so that the cable main body S2 therein is exposed, i.e., the first connection part 221 is connected to the cable main body S2.

Figure 5:
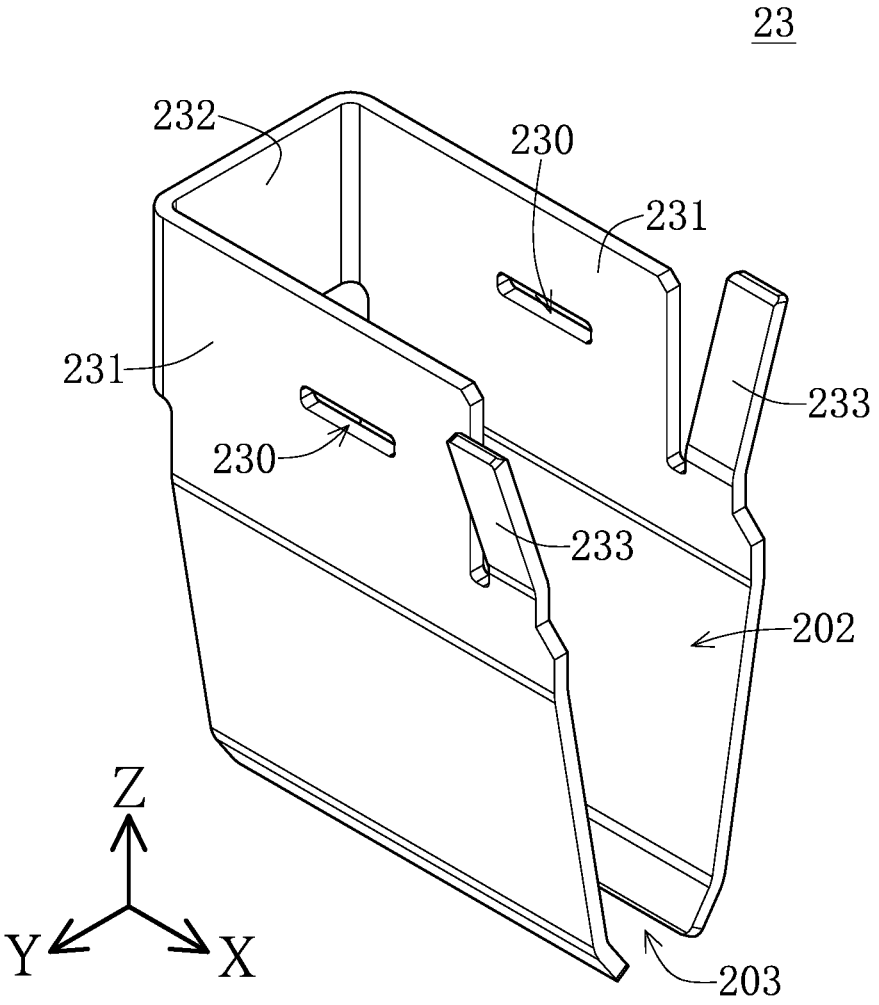
FIG. 5 is a schematic perspective view of a terminal holding member of the electrical connector assembly according to the present disclosure.

Referring to FIG. 1 and FIG. 5, FIG. 5 is a schematic perspective view of the terminal holding member of the electrical connector assembly according to the present disclosure. The terminal holding member 23 is arranged in the housing 1 and at a periphery of the electrically conductive terminal 21. The terminal holding member 23 has two sheet bodies 231 that are arranged opposite to each other and a plate-shaped connection part 232 connected between same sides of the two sheet bodies 231. Accordingly, as shown in FIG. 5, in a top view (i.e., in a direction of a negative Z-axis), the terminal holding member 23 is U-shaped, and a guide opening 202 that is opposite to the plate-shaped connection part 232 is formed on a side of the terminal holding member 23. In addition, the two sheet bodies 231 are respectively bent along directions towards each other when extending from the top (i.e., in the direction of the negative Z-axis), such that a third socket 203 is formed.

Referring to FIG. 3 to FIG. 6, FIG. 6 is a schematic perspective view of the electrically conductive connection member of the electrical connector assembly according to the present disclosure. The terminal holding member 23 further has two through holes 230, the electrically conductive terminal 21 further has two cantilever hooks 213 corresponding to the two through holes 230, and each of the two cantilever hooks 213 is arranged on the base 2111. Therefore, when the electrically conductive terminal 21 is inserted into the terminal holding member 23 through the guide opening 202, each of the two cantilever hooks 213 is engaged to the corresponding through hole 230. Furthermore, a terminal of each of the two cantilever hooks 213 has an inclined surface 2131, and the inclined surface 2131 extends and inclines inwardly along a direction of a negative X-axis. When the electrically conductive terminal 21 is assembled in the terminal holding member 23, the electrically conductive terminal 21 is inserted into the terminal holding member 23 through the guide opening 202. Furthermore, the electrically conductive terminal 21 is inserted into the terminal holding member 23 through the guide opening 202 along the direction of the negative X-axis. In other words, the inclined surface 2131 of one of the two cantilever hooks 213 extends and inclines inwardly in an insertion direction along which the electrically conductive terminal 21 is inserted into the terminal holding member 23, or the inclined surface 2131 extends and expands outwardly along a direction of a positive X-axis, i.e., a distance between the two inclined surfaces 2131 corresponding to the two cantilever hooks 213 changes from being narrow to being wide in the positive direction along the X-axis. In this way, the electrically conductive terminal 21 can be smoothly inserted into the terminal holding member 23, and a resistance between the two sheet bodies 231 of the terminal holding member 23 and terminal surfaces corresponding to the two cantilever hooks 213 can be reduced. In addition, when the electrically conductive terminal 21 is inserted into the terminal holding member 23, the third socket 203 aligns with the second socket 201.

It is worth mentioning that, in the present disclosure, when the electrically conductive terminal 21 is not assembled in the terminal holding member 23, a width of the second socket 201 is less than a width of the third socket 203. The width of the second socket 201 can be defined as a distance between two contact areas 2113 plus a thickness of the two elastic contact arms 2112, wherein the two contact areas 2113 are two areas of the two elastic contract arms 2112 with a closest distance therebetween. The width of the third socket 203 can be defined as a closest distance between the two sheet bodies 231 when the two sheet bodies 231 are respectively bent along the directions towards each other. In other words, since the width of the second socket 201 is less than the width of the third socket 203 when the electrically conductive terminal 21 is not assembled in the terminal holding member 23, the electrically conductive terminal 21 does not particularly push out the terminal holding member 23 and the terminal holding member 23 does not particularly apply a positive force to two sides of the electrically conductive terminal 21 to clamp the electrically conductive terminal 21 when the electrically conductive terminal 21 is assembled in the terminal holding member 23 and a plug (not shown) is not being inserted into the second socket 201. In contrast, conventional terminal clamps are inherently flexible, such that the conventional terminal clamp unlike the terminal holding members of the present disclosure apply the positive force to two sides of electrically conductive terminals to clamp the electrically conductive terminals when the conventional terminal clamps are assembled with the electrically conductive terminals, thereby causing difficulties during assembly. In other words, compared with the conventional technology, a design of the electrically conductive terminal 21 and the terminal holding member 23 of the present disclosure allows users to perform assembly more easily.

Figure 6:
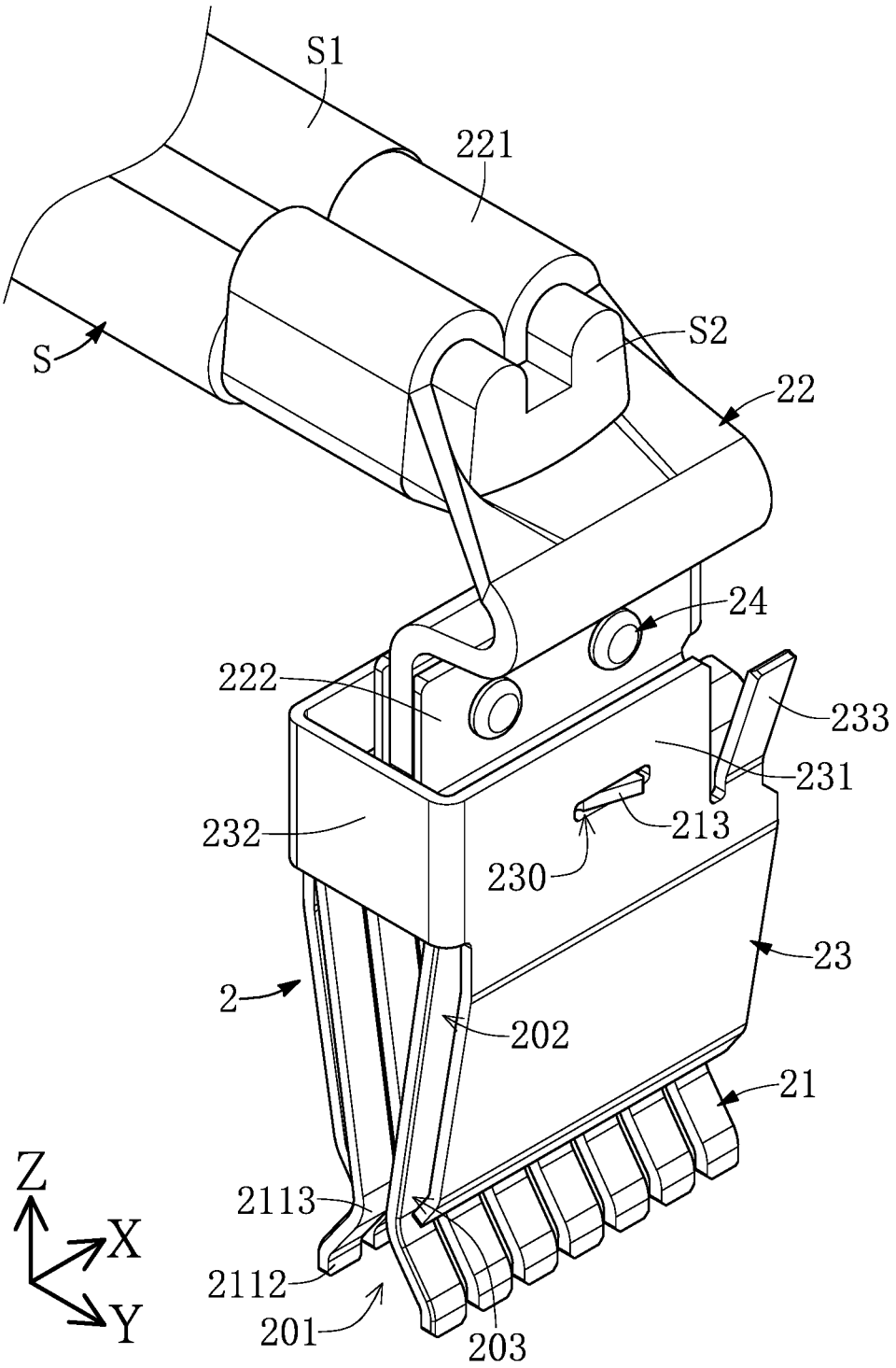
FIG. 6 is a schematic perspective view of an electrically conductive connection member of the electrical connector assembly according to the present disclosure.
Figure 10:
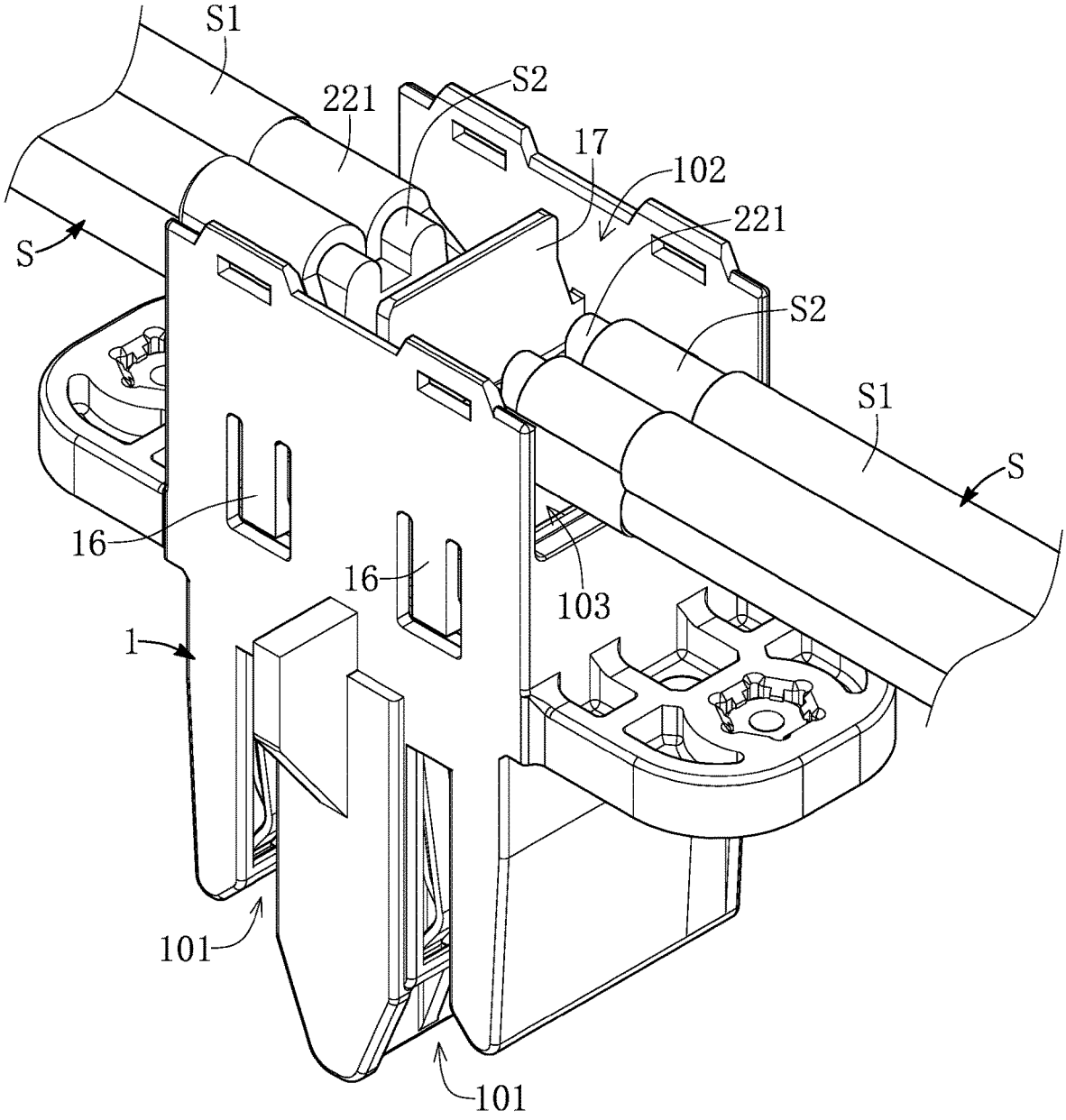
FIG. 10 is a schematic perspective view of the electrical connector assembly having a cover removed according to the present disclosure.

As mentioned above, the U-shaped connection part 212 of the electrically conductive terminal 21 has two bar-shaped arms 2121 and a U-shaped arm 2122. The two bar-shaped arms 2121 are respectively connected to the two bases 2111 of the two leaf springs 211, and the U-shaped arm 2122 is connected between same sides of the two bar-shaped arms 2121. When the electrically conductive terminal 21 is assembled in the terminal holding member 23, the U-shaped arm 2122 and the plate-shaped connection part 232 are respectively arranged on two sides of the electrically conductive connection member 2 that are opposite to each other. The electrically conductive connection member 2 has at least one fastener 24, and each of the two bar-shaped arms 2121 has at least one first through hole 2120 that correspond to each other. The second connection part 222 of the cable connection member 22 is arranged between the two bar-shaped arms 2121, and the second connection part 222 has at least one second through hole 2220. The at least one first through hole 2120 of each bar-shaped arm 2121 is aligned with the at least one second through hole 2220. In the present embodiment, each of the two bar-shaped arms 2121 has the at least one through hole 2120, and the second connection part 222 arranged between the two bar-shaped arms 2121 has the corresponding at least one second through hole 2220. The at least one fastener 24 of the electrically conductive connection member 2 passes through the at least one first through hole 2120 of one of the two bar-shaped arms 2121 and the at least one first through hole 2120 of another one of the two bar-shaped arms 2121 that correspond to each other, and through the second through hole 2220 arranged between the two first through holes 2120. Therefore, the second connection part 222 is fixed on the U-shaped connection part 212. The present disclosure is not limited to a type of the fastener 24 and, for example, the fastener 24 can be a rivet. At least one rivet of the electrically conductive connection member 2 passes through the at least one second through hole 2220 and the two of the first through holes 2120 that correspond to each other, such that the second connection part 222 is fixed on the U-shaped connection part 212. In addition, before a process of crimping, the first connection part 221 of the cable connection member 22 has a wing-shaped structure that extends to two sides thereof, and the exposed cable main body S2 at the one terminal of the electrically conductive cable S contacts and is arranged on the first connection part 221. Next, the wing-shaped structure of the first connection part 221 that extends to two sides thereof is bent inwardly and covers the exposed cable main body S2, and the process of crimping is performed. Thereby, the electrically conductive connection member 2 physically contacts and is electrically connected to the electrically conductive cable S. Referring to FIG. 6 and FIG. 10, FIG. 10 is a schematic perspective view of the electrical connector assembly having a cover being removed according to the present disclosure. When the two electrically conductive connection members 2 are inserted into and assembled in the housing 1 through the opening 102, the second sockets 201 of the two electrically conductive connection members 2 correspond to the two first sockets 101, and the second socket 201 of each of the two electrically conductive terminals 21 is communicated with the corresponding first socket 101.

Figure 7:
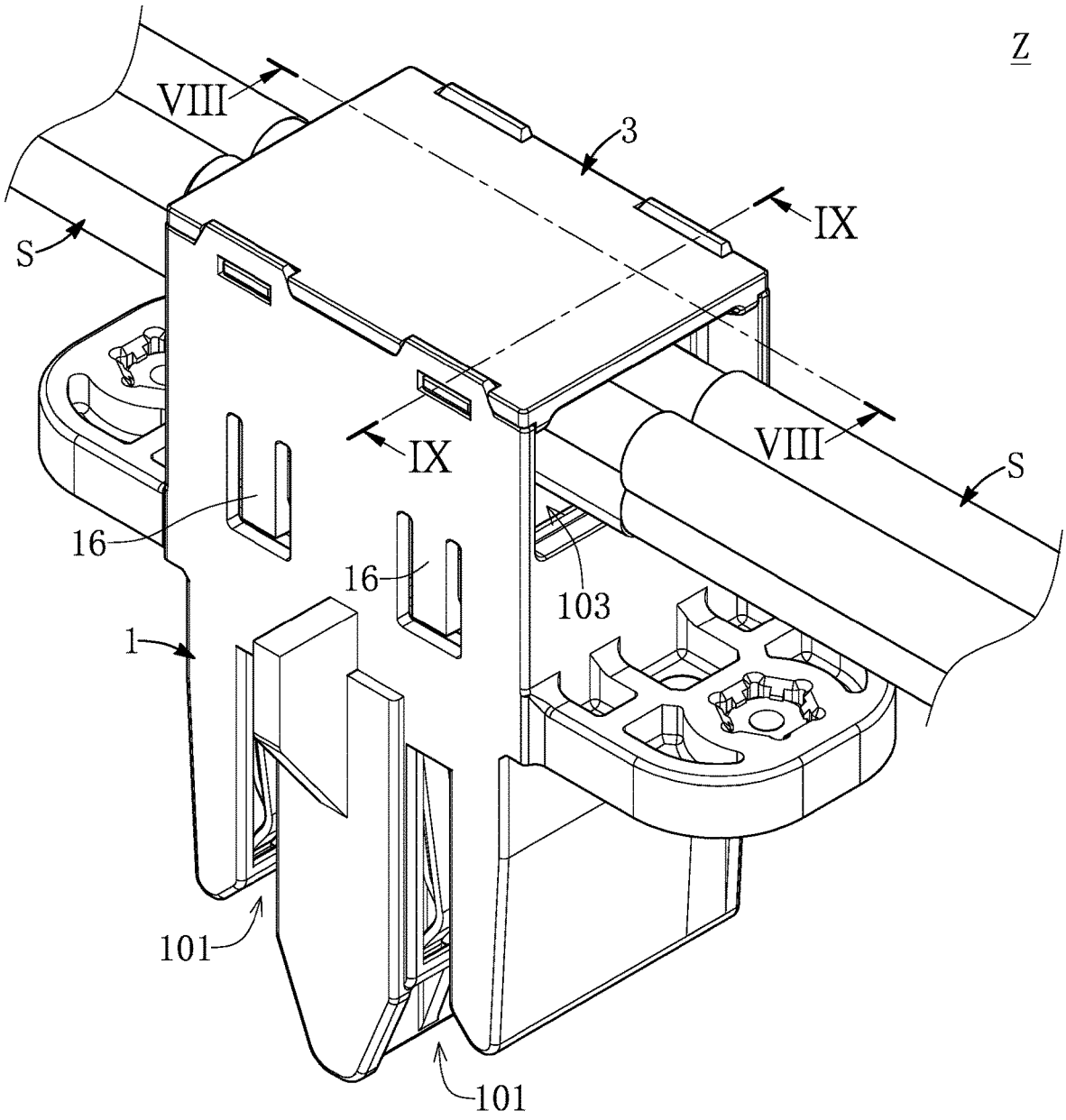
FIG. 7 is a schematic perspective view of the electrical connector assembly according to the present disclosure.
Figure 8:
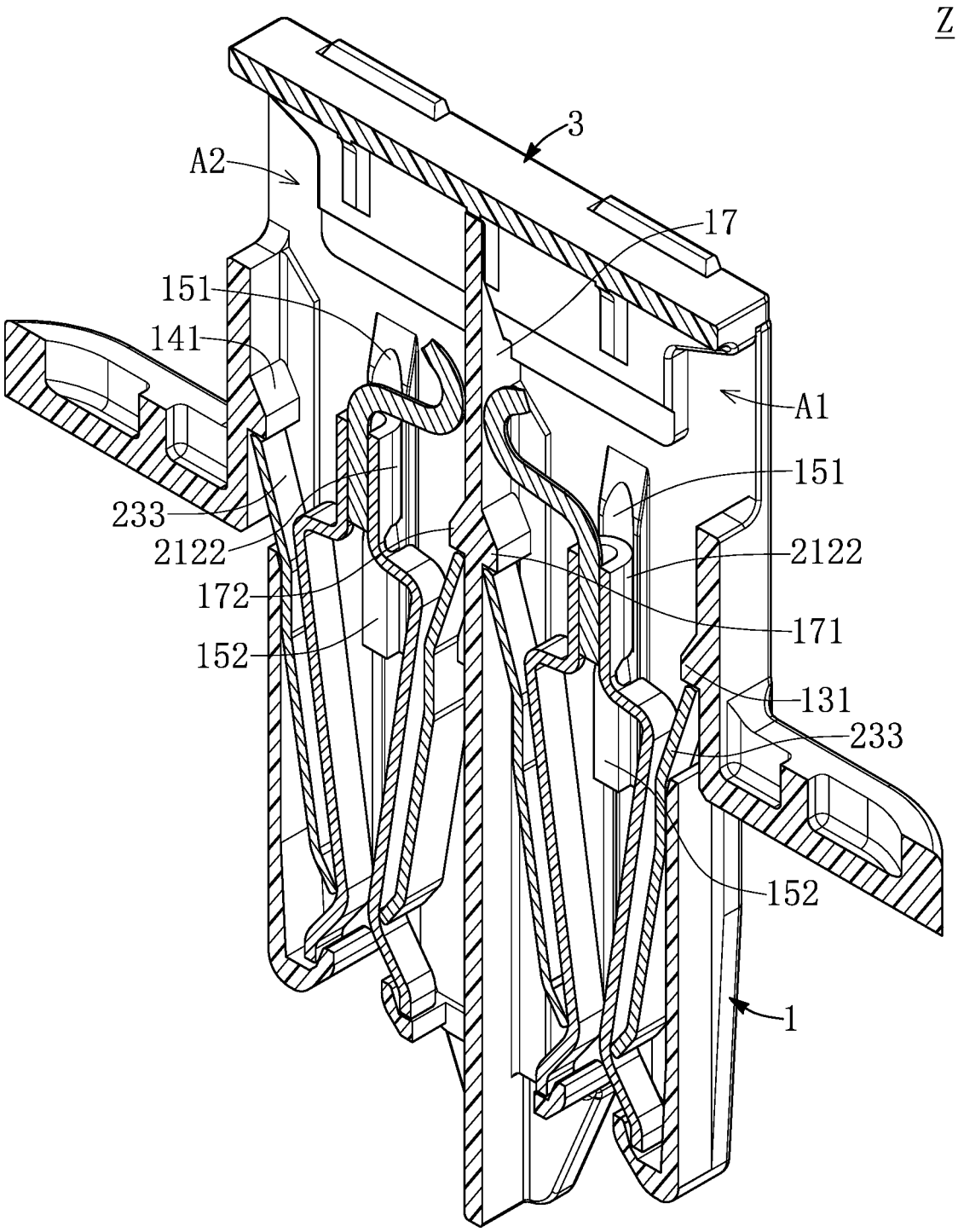
FIG. 8 is a cross-sectional view taken along line VIII-VIII of FIG. 7.
Figure 9:
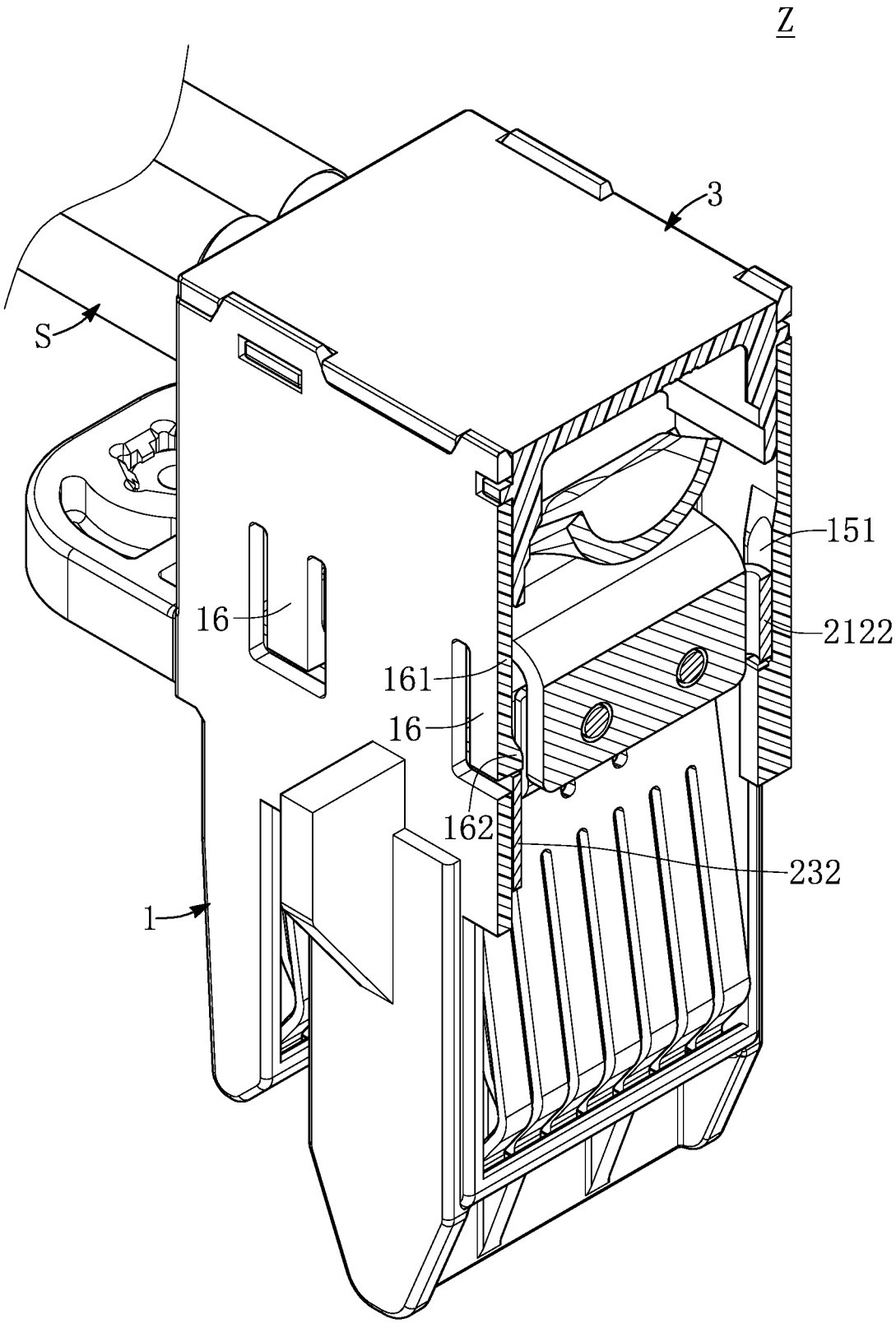
FIG. 9 is a cross-sectional view taken along line IX-IX of FIG. 7.

Referring to FIG. 7 to FIG. 9, FIG. 7 is a schematic perspective view of the electrical connector assembly according to the present disclosure, FIG. 8 is a cross-sectional view taken along line VIII-VIII of FIG. 7, and FIG. 9 is a cross-sectional view taken along line IX-IX of FIG. 7. The electrical connector assembly Z of the present disclosure further includes a cover 3. The cover 3 is detachably disposed on the side where the housing 1 has the opening 102. When the cover 3 is disposed on the housing 1, an inner side of the cover 3 is next to the partition 17. That is to say, the first accommodating space A1 is not connected to the second accommodating space A2, and the two electrically conductive cables S respectively connected to the two electrically conductive connection members 2 that are correspondingly arranged in the first accommodating space A1 and the second accommodating space A2 correspondingly extend from two lateral openings 103 that are correspondingly formed on two sides of the electrical connector assembly Z. In addition, as shown in FIG. 8, a first stop block 171 and a second stop block 172 are respectively arranged on two sides of the partition 17, a third stop block 131 is arranged on an inner side of the third side wall 13, and a fourth stop block 141 is arranged on an inner side of the fourth side wall 14. The first stop block 171 and the third stop block 131 are arranged in the first accommodating space A1, and the second stop block 172 and the fourth stop block 141 are arranged in the second accommodating space A2. As shown in FIG. 9, each of the two cantilever members 16 has a first terminal 161 and a second terminal 162 that are opposite to each other. The first terminal 161 is connected to the second side wall 12, the second terminal 162 is overhung, and a thickness of the second terminal 162 is greater than a thickness of the first terminal 161. Moreover, a free terminal of the cantilever member 16 protrudes inwardly.

Referring to FIG. 5, the terminal holding member 23 further has two bent segments 233. Each of the two bent segments 233 is adjacent to the guide opening 202 and is connected to the sheet body 231. When one of the two electrically conductive connection members 2 along with the terminal holding member 23 is assembled in the first accommodating space A1, the two bent segments 233 of the terminal holding member 23 respectively abut the first stop block 171 and the third stop block 131, the plate-shaped connection part 232 abuts the corresponding second terminal 162 of the two cantilever members 16, and the U-shaped arm 2122 of the U-shaped connection part 212 is arranged in the sliding groove 151 of the first accommodating space A1 and abuts a corresponding one of the bump 152. When another one of the two electrically conductive connection members 2 is assembled in the second accommodating space A2, the two bent segments 233 of the terminal holding member 23 of the another one of the two electrically conductive connection members correspondingly abut the second stop block 172 and the fourth stop block 141, and similarly, the plate-shaped connection part 232 abuts the corresponding second terminal 162 of the two cantilever members 16, and the U-shaped arm 2122 is arranged in the sliding groove 151 of the second accommodating space A2 and abuts a corresponding one of the bump 152.

Beneficial Effects of the Embodiments

In conclusion, one of the beneficial effects of the present disclosure is that, by virtue of "the electrically conductive terminal 21 having the two leaf springs 211 that are opposite to each other and the U-shaped connection part 212 connected between the two leaf springs 211", "the first connection part 221 being connected the one terminal of the electrically conductive cable S by crimping, and the second connection part 222 being coupled to the U-shaped connection part 212", and "the terminal holding member 23 having the two sheet bodies 231 that are arranged opposite to each other and the plate-shaped connection part 232 connected between the same sides of the two sheet bodies 231, so that the terminal holding member 23 is U-shaped and the guide opening 202 that is opposite to the plate-shaped connection part 232 is formed on the side of the terminal holding member 23," a quantity of internal components and an assembly process can be simplified in the electrical connector assembly Z provided by the present disclosure, and a structural strength of the electrical connector assembly after assembly can be enhanced, such that the internal components can be prevented from loosening or shifting after repeated use. Furthermore, the terminal of each of the cantilever hooks 213 has the inclined surface 2131, and the inclined surface 2131 extends and inclines inwardly along the direction of the negative X-axis (i.e., the insertion direction along which the electrically conductive terminal 21 is inserted into the terminal holding member 23), or the inclined surface 2131 extends and expands outwardly along the direction of the positive X-axis, i.e., the distance between the two inclined surfaces 2131 corresponding to the two cantilever hooks 213 changes from being narrow to being wide in the positive direction along the X-axis. In this way, the electrically conductive terminal 21 can be smoothly inserted into the terminal holding member 23, and the resistance between the sheet bodies 231 of the terminal holding member 23 and the terminal surfaces corresponding to the two cantilever hooks 213 can be reduced. In addition, when the electrically conductive terminal 21 is inserted into the terminal holding member 23, the third socket 203 aligns with the second socket 201.

Furthermore, in the present disclosure, when the electrically conductive terminal 21 is not assembled in the terminal holding member 23, the width of the second socket 201 is less than the width of the third socket 203. Since the width of the second socket 201 is less than the width of the third socket 203 when the electrically conductive terminal 21 is not assembled in the terminal holding member 23, the electrically conductive terminal 21 does not particularly push out the terminal holding member 23 and the terminal holding member 23 does not particularly apply the positive force to the two sides of the electrically conductive terminal 21 to clamp the electrically conductive terminal 21 when the electrically conductive terminal 21 is assembled in the terminal holding member 23. In other words, compared with the conventional technology, the design of the electrically conductive terminal 21 and the terminal holding member 23 of the present disclosure allows users to perform assembly more easily.

The foregoing description of the exemplary embodiments of the disclosure has been presented only for the purposes of illustration and description and is not intended to be exhaustive or to limit the disclosure to the precise forms disclosed. Many modifications and variations are possible in light of the above teaching.

The embodiments were chosen and described in order to explain the principles of the disclosure and their practical application so as to enable others skilled in the art to utilize the disclosure and various embodiments and with various modifications as are suited to the particular use contemplated. Alternative embodiments will become apparent to those skilled in the art to which the present disclosure pertains without departing from its spirit and scope.

What is claimed is:

1. An electrical connector assembly, comprising:

a housing, having two sides opposite to each other, wherein one of the two sides has two first sockets, and another one of the two sides has an opening; and two electrically conductive connection members each arranged in the housing and connected to at least one electrically conductive cable, and each of the two electrically conductive connection members including:

an electrically conductive terminal arranged in the housing, wherein the electrically conductive terminal is integrally formed, the electrically conductive terminal has two leaf springs that are opposite to each other and a U-shaped connection part connected between the two leaf springs, each of the two leaf springs has a base and a plurality of elastic contact arms, the plurality of elastic contact arms are connected to a side of the base, and a second socket is formed between the two leaf springs;

a cable connection member connected to the electrically conductive terminal and the corresponding electrically conductive cable, wherein the cable connection member is bent and has a first connection part and a second connection part, the first connection part is connected to a terminal of the electrically conductive cable by crimping, and the second connection part is coupled to the U-shaped connection part; and a terminal holding member arranged in the housing and at a periphery of the electrically conductive terminal, wherein the terminal holding member has two sheet bodies that are arranged opposite to each other and a plate-shaped connection part connected between same sides of the two sheet bodies, a guide opening that is opposite to the plate-shaped connection part is formed on a side of the terminal holding member, the two sheet bodies are bent in a direction towards each other such that a third socket is formed therebetween;

wherein, when the electrically conductive terminal is assembled in the terminal holding member, the electrically conductive terminal is inserted into the terminal holding member through the guide opening;

wherein, when the two electrically conductive connection members are assembled in the housing through the opening, the second sockets of the two electrically conductive terminals correspond to the two first sockets, and the second socket of each of the two electrically conductive terminals is communicated with the corresponding first socket.

2. The electrical connector assembly according to claim 1, wherein, when the electrically conductive terminal is not assembled in the terminal holding member, a width of the second socket is less than a width of the third socket.

3. The electrical connector assembly according to claim 1, wherein the housing further has a first side wall and a second side wall that are opposite to each other, and the housing has a third side wall and a fourth side wall that are arranged between the first side wall and the second side wall and are opposite to each other; wherein two guide members are arranged on an inner side of the first side wall, and each of the two guide members has a sliding groove and a bump arranged at one terminal of the sliding groove; wherein two cantilever members are arranged on the second side wall, each of the two cantilever members has a first terminal and a second terminal that are opposite to each other, the first terminal is connected to the second side wall and the second terminal is overhung, and a thickness of the second terminal is greater than a thickness of the first terminal.

4. The electrical connector assembly according to claim 3, wherein the plate-shaped connection part correspondingly abuts the two second terminals of the two cantilever members.

5. The electrical connector assembly according to claim 3, wherein the U-shaped connection part is arranged in a corresponding one of the two sliding grooves and abuts a corresponding one of the bump.

6. The electrical connector assembly according to claim 3, wherein the housing further has a partition, the partition is arranged in the housing and connected between the first side wall and the second side wall so as to divide an inside of the housing into a first accommodating space and a second accommodating space, and the two electrically conductive connection members are respectively arranged in the first accommodating space and the second accommodating space; wherein a first stop block and a second stop block are correspondingly arranged on two sides of the partition, a third stop block is arranged on an inner side of the third side wall, and a fourth stop block is arranged on an inner side of the fourth side wall; wherein the first stop block and the third stop block are arranged in the first accommodating space, and the second stop block and the fourth stop block are arranged in the second accommodating space.

7. The electrical connector assembly according to claim 6, wherein the terminal holding member further has two bent segments, and each of the two bent segments is adjacent to the guide opening and is correspondingly connected to one of the two sheet bodies; wherein, when one of the two electrically conductive connection members is assembled in the first accommodating space, the two bent segments of the terminal holding member of the one of the two electrically conductive connection members correspondingly abut the first stop block and the third stop block; and wherein, when another one of the two electrically conductive connection members is assembled in the second accommodating space, the two bent segments of the terminal holding member of the another one of the two electrically conductive connection members correspondingly abut the second stop block and the fourth stop block.

8. The electrical connector assembly according to claim 6, further comprising:

a cover detachably disposed on the side of the housing that has the opening;

wherein, when the cover is disposed on the housing, an inner side of the cover is next to the partition.

9. The electrical connector assembly according to claim 1, wherein the terminal holding member further has two through holes, the electrically conductive terminal further has two cantilever hooks corresponding to the two through holes, and each of the two cantilever hooks is arranged on the base; and wherein, when the electrically conductive terminal is inserted into the terminal holding member through the guide opening, each of the two cantilever hooks is engaged to the corresponding through hole.

10. The electrical connector assembly according to claim 9, wherein a terminal of each of the two cantilever hooks has an inclined surface, and the inclined surface extends and inclines inwardly in an insertion direction along which the electrically conductive terminal is inserted into the terminal holding member.

11. The electrical connector assembly according to claim 1, wherein the U-shaped connection part has two bar-shaped aims and a U-shaped arm, the two bar-shaped arms are correspondingly connected to the two bases of the two leaf springs, the U-shaped arm is connected between the same sides of the two bar-shaped arms, and the U-shaped arm and the plate-shaped connection part are correspondingly arranged on two sides of the electrically conductive connection member that are opposite to each other.

12. The electrical connector assembly according to claim 11, wherein the electrically conductive connection member has at least one fastener, and each of the two bar-shaped arms has at least one first through hole that corresponds to each other; wherein the second connection part of the cable connection member is arranged between the two bar-shaped arms, the second connection part has at least one second through hole, the at least one second through hole is arranged between two of the first through holes of the two bar-shaped arms that correspond to each other, and the at least one second through hole is correspondingly communicated with the two of the first through holes of the two bar-shaped arms that correspond to each other; and wherein the at least one fastener passes through the at least one second through hole and the two of the first through holes of the two bar-shaped arms that correspond to each other, such that the second connection part is coupled to the U-shaped connection part.

* * * * *